United States Patent [19]

Yates

[11] 4,077,697

[45] Mar. 7, 1978

[54] WIRE CONNECTING DEVICES

[76] Inventor: Curtis D. Yates, 10617 E. 53rd St., Raytown, Mo. 64133

[21] Appl. No.: 678,058

[22] Filed: Apr. 19, 1976

[51] Int. Cl.[2] ..... H01R 7/06

[52] U.S. Cl. ..... 339/274; 24/115 G; 24/132 AC; 339/270 R; 403/215

[58] Field of Search ..... 339/270 R, 274; 24/115 R, 132 R, 132 AA, 132 AB, 132 AC; 403/206, 215, 216, 293

[56] References Cited

U.S. PATENT DOCUMENTS

| | | | |
|---|---|---|---|
| 2,388,724 | 11/1945 | Cornella | 339/274 |
| 2,680,145 | 6/1954 | Lanfear | 339/274 |
| 3,042,896 | 7/1962 | Doktor | 339/274 |
| 3,973,822 | 8/1976 | Sugimoto | 339/274 |

FOREIGN PATENT DOCUMENTS

| | | | |
|---|---|---|---|
| 698,501 | 11/1940 | Germany | 24/132 AC |

*Primary Examiner*—Roy Lake
*Assistant Examiner*—Mark S. Bicks
*Attorney, Agent, or Firm*—Thomas M. Scofield

[57] ABSTRACT

Improved devices for making electrical terminal and wire-to-wire connections; in terminal type connections, improved devices for physically and electrically joining one or more electricity-conducting wires to novel terminal constructions; in wire-to-wire connections, novel improved devices for electrically and physically connecting together two or more electricity-conducting wires; wire receiving sleeve members adapted to cooperate with novel electrical terminals or other, like sleeve members and a terminal interconnection therebetween, for purposes of new advantageous physical and electrical connections of wires or wires and terminal members; means for removably locking together the connected parts of such electrical terminal and wire to wire connections.

13 Claims, 21 Drawing Figures

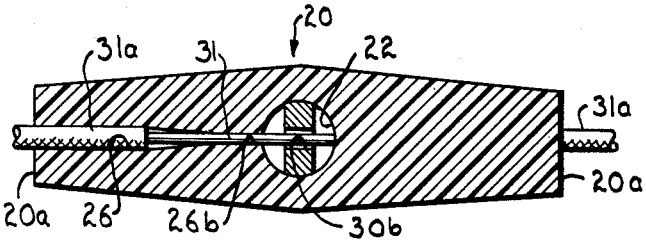
Fig. 5.
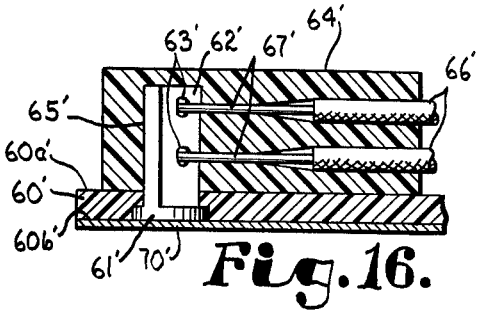
Fig. 16.
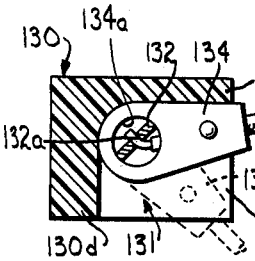
Fig. 20.
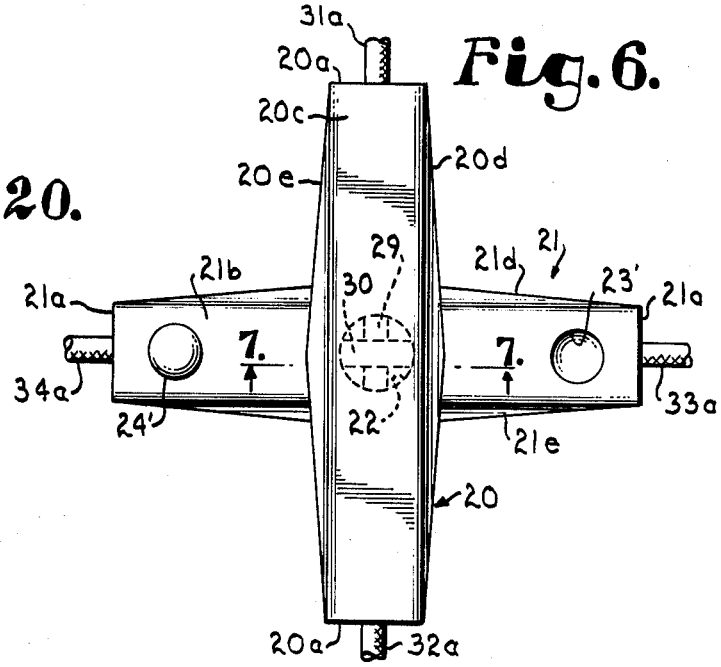
Fig. 6.
Fig. 9.
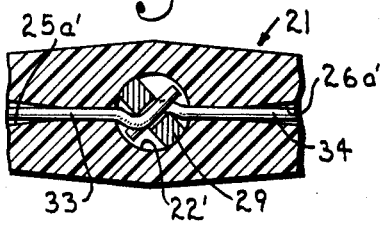
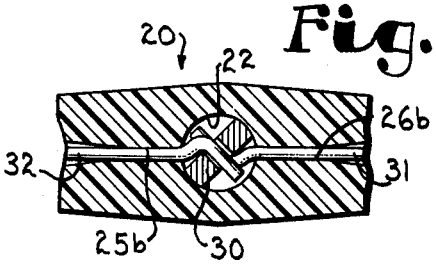
Fig. 10.
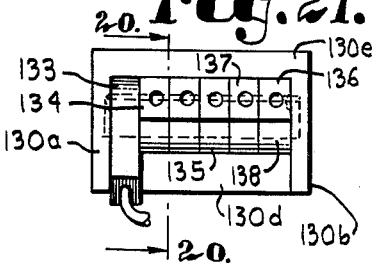
Fig. 21.
Fig. 11.
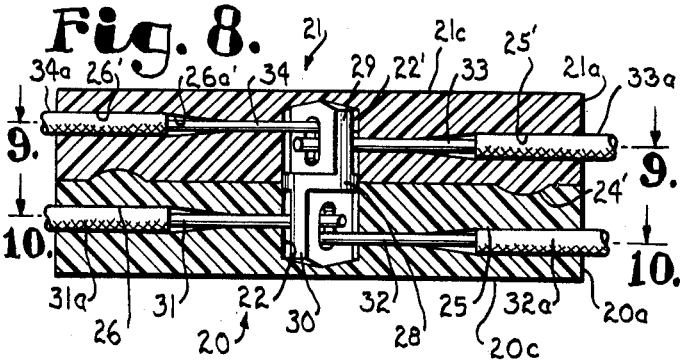
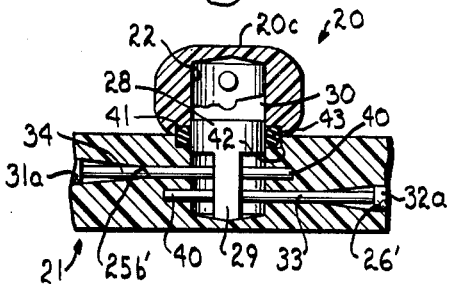

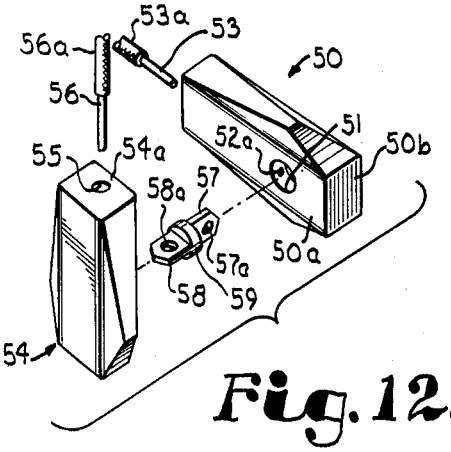
Fig. 12.
Fig. 13.
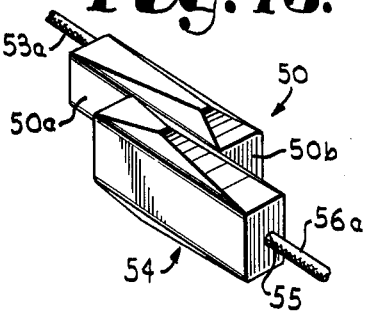
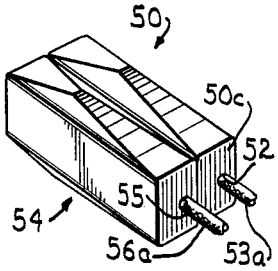
Fig. 14.
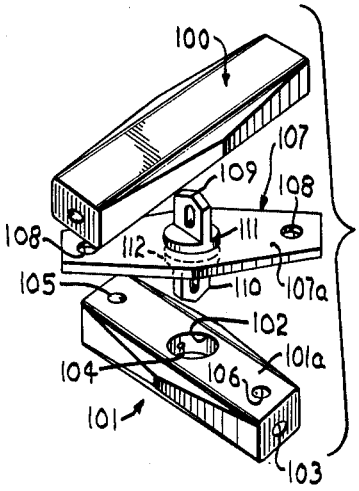
Fig. 19.
Fig. 15.
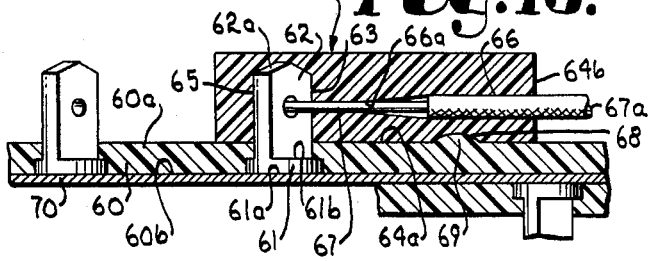
Fig. 17.
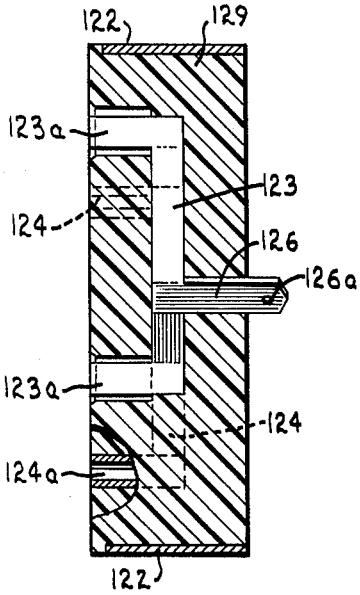
Fig. 18.
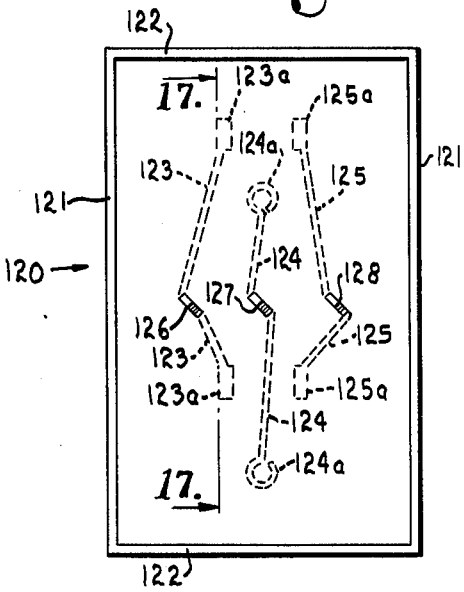

WIRE CONNECTING DEVICES

PRIOR ART

I am aware of the following patents directed to wire connecting devices or electrical terminals:

Cornella U.S. Pat. No. 2,388,724, issued Nov. 13, 1945 for "Wire Connector";

Stonehill U.S. Pat. No. 2,553,341, issued May 15, 1951 for "Electrical Terminal"; and Doktor U.S. Pat. No. 3,042,896, issued July 3, 1962 for "Terminal Block Construction".

OBJECTS OF THE INVENTION

The basic object of the instant invention is to provide improved connector means usable in making electrical connections between one or more electricity conducting wires and a junction or two or more other such wires.

Another object of the invention is to provide new single and multiple wire connector devices in electricity conducting systems, which connectors are of extremely simple construction, inexpensive to fabricate, easily employed in making many desired connections and which are strong and rugged, as well as dependable over long periods of continuous or intermittent use.

Another object is to provide such improved connector devices which make completely effective, totally reliable and secure electrical connections between one or a plurality of wires and one or more junctions or other wires, for so long as the connector device is applied to the wire or wires in question, such connector device additionally easily and readily disengageable from the connected electrical means at will.

Another object of the invention is to provide such improved connector devices for electrically connecting one or a plurality of wires to one another or a junction, wherein the connector device may be first employed to secure together or to a junction a first wire or plurality of wires. Thereafter, such connector device may be, at will, readily uncoupled from the originally connected junction, wire or wires and, finally, again reconnected with the original junction, wire, wires, or a different junction, wire or wires without any requirement whatsoever of repair or replacement of the original connector device or member first employed.

Another object of the invention is to provide connectors of the character described, wherein the coupling together or to a junction of from one to a plurality of wires may be accomplished in an extremely short time interval, yet wherein the said coupling or connection, once made, is completely secure and extremely strong, as well as totally electrically effective.

Another object of the invention is to provide such novel wire connecting means and devices wherein certain operative portions of the connector assembly may permanently be fixed in a terminal box or at any fixed location, thereby to definitely locate the position of the ultimate connection, same completed when the rest of the operative portions of the connector assembly are joined therewith, as well as one or more electrical wires.

Another object of the invention is to provide novel and useful connection means for electrically and physically connecting together (or to a junction) one or a plurality of electricity conducting wires, which means do not in any way require the use therewith of independent or special insulation means, because the connection itself integrally carries and embodies its own necessary insulation. Such means also operate to removably lock together the connected elements.

Another object of the invention is to provide numerous novel connectors of the character described, which connectors do not in any way require use of solder, springs, screws or special tools, yet which, in use, provide quick, positively applicable electrical connections. Once applied, additionally, such new connector devices and means may be readily disengaged for purposes of changing, adding to or deleting one or more wires from the original connection at any time depending on its basic structure.

Other and further objects of the invention will appear in the course of the following description thereof.

DESCRIPTION OF THE DRAWINGS

In the drawings, which form a part of the instant specification and are to be read in conjunction therewith, embodiments of the instant invention are shown and, in the various views, like numerals are employed to indicate like parts.

FIGS. 1–11, INCLUSIVE

FIG. 1–11, inclusive, show a basic, first form of electrical connector means which is adapted to physically and electrically connect together from two to four wires. FIGS. 1–10, inclusive show the same, identical structure in various views, including stages of assembly and actuation thereof. FIG. 11 is a minor structural variation of certain parts of the connector of FIGS. 1–10, inclusive.

FIG. 1 is a three-quarter perspective view from above of a first form of the subject connector devices, illustrated in operation, actively and electrically connecting together four different electricity conducting wires.

FIG. 2 is an exploded view of the parts of the first form of the invention, illustrated in three-quarter perspective view from above, the view taken before engagement of the wires to be connected together with the particular parts of the device. Two wires to be connected are shown adjacent to the lefthand member in the view and two more wires to be connected are shown adjacent to the righthand member in the view.

FIG. 3 is a sectional view through one of the connector (wire engaging) elements showing the first stage in assembly of a multiple wire electrical connection using the device of FIGS. 1–10, inclusive, with a first wire shown inserted into the said one connector element and, additionally, into the interconnecting member which engages both such connector elements.

FIG. 4 is a view like that of FIG. 3, but showing a second stage in assembly of a multiple wire electrical connector and showing the connector of FIG. 3 having a second wire inserted thereinto, same also engaging the said interconnecting member.

FIG. 5 is a view taken along the lines 5—5 of FIG. 4 in the direction of the arrows.

FIG. 6 is a side view of the two wire receiving elements of the electrical connector of FIGS. 1–10, inclusive, each engaged by two wires (for a total of four being connected by the connector), the two wire receiving elements coupled together by the third element seen centrally of the view of FIG. 2 before pivoting the two elements into alignment with one another for completion of the electrical connection by causing the intermediate member to positively engage all the wires.

FIG. 7 is a view taken from the bottom side of the view of FIG. 6 looking upwardly, with the upper portion of the view taken along the section line 7—7 of FIG. 6 in the direction of the arrows.

FIG. 8 is a sectional view through the actuated connecting device as seen in FIG. 1, the view of FIG. 8 taken essentially in a horizontal plane centrally through the view of FIG. 1. Said otherwise, the view of FIG. 8 is looking vertically down on the actuated connector of FIG. 1 with the latter sectioned horizontally so as to show the position of the connected wires therein, as well as the position of the intermediate member in the elements.

FIG. 9 is a view taken along the line 9—9 of FIG. 8 in the direction of the arrows of the central portion of the top half of FIG. 8.

FIG. 10 is a view taken along the line 10-10 of FIG. 8 in the direction of the arrows of the central portion of the lower half of FIG. 8.

FIG. 11 is a fragmentary view analogous to the center portion of FIG. 7 showing two modifications over the connector of FIGS. 1-10, inclusive.

FIGS. 12-14, INCLUSIVE

FIG. 12 is a three-quarter perspective view from above, exploded, of a second form of the subject improved connector.

FIG. 13 is a three-quarter perspective view from above of the assembled connector of FIG. 12 connecting two wires positioned so as to extend away from one another, illustrating a feed through condition.

FIG. 14 shows the connector of FIGS. 12 and 13 functioning in a manner opposite to that of FIG. 13, namely, connecting two wires which extend in the same direction, illustrating a feed return condition.

FIGS. 15-21, INCLUSIVE

FIG. 15 is a vertical section through a connector of a structure like one-half of the connector of FIGS. 12-14, inclusive, same engaged with a conducting blade fixed in an electrically insulating block or board and providing particular connection to certain existing circuitry.

FIG. 16 is a view like that of FIG. 15, but showing the connector adapted to engage two wires, rather than one.

FIG. 17 is a sectional view of a duplex outlet taken along the lines 17—17 of FIG. 18 in the direction of the arrows.

FIG. 18 is a view of the duplex outlet seen in FIG. 17 looking from right to left in the view of FIG. 17.

FIG. 19 is a modified form of wire connector showing the wire receiving members of the connector of FIGS. 1-11, inclusive employed with an intermediate member which isolates the two halves of the connection, one from the other, electrically.

FIG. 20 is a side sectional view of a housing having a bus bar mounted therewithin, there being provided a plurality of pivotable members mounted on said bus bar and movable from a first, nonlocking position (dotted lines) to a locked or engaged position (full lines) to complete an electrical connection of incoming and/or outgoing wires with respect to the bus bar.

FIG. 21 is a view of the device of FIG. 20 looking from the righthand side of the view to the left in the view of FIG. 20.

CONNECTOR STRUCTURE FIGS. 1-10, INCLUSIVE

Figure 1:
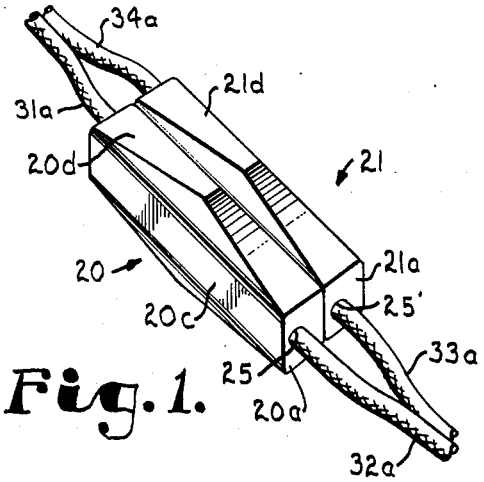

Referring to the drawings, at 20 and 21, respectively, are generally designated two, individual, identical (an operating pair) elongate, wire receiving members fabricated, constructed or molded of electrically insulating material of quality to meet performance demand. The members 20 and 21 preferably have (but not necessarily) a substantially rectangular section both in transverse longitudinal section whereby to provide substantially rectangular, flat, end wall faces 20*a* and 21*a*, inner, preferably substantially flat abutting side walls 20*b* and 21*b*, outer, conveniently rectangular and optionally substantially flat side wall faces 20*c* and 21*c* and upper and lower longitudinal walls or wall surfaces 20*d* and 20*e* and 21*d* and 21*e*, respectively. The latter may be centrally outwardly tapered and bevelled as illustrated for convenience in handling and use, as well as decorative purposes.

Figure 3:
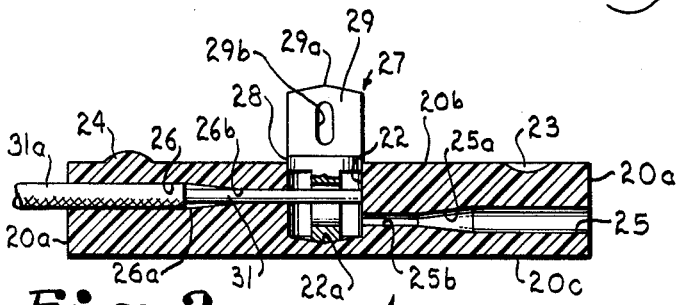
Figure 4:
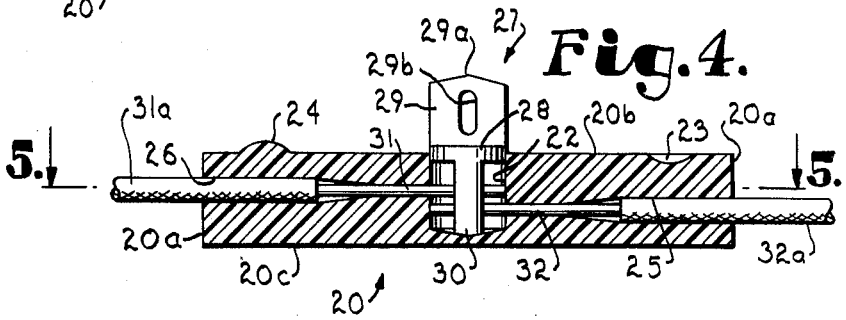

Referring, now, specifically to the elongate, wire receiving member 20, detailed in FIGS. 3, 4 and 5, the following structural features are noted. A cylindrical bore or recess 22 is provided in member 20 extending inwardly of member 20 from flat side face 21*b* short of, but approaching wall 20*c*. The inboard end 22*a* is preferably of flattened conical form as seen in FIGS. 3 and 4. Bore 22 is preferably centrally located intermediate the ends 20*a* of member 20, as well as centrally between the walls 20*d* and 20*e*. Positioned equidistant from ends 20*a* and also bore 22 are an arcuate recess 23 and a congruent, arcuate protuberance or raised portion 24 on face 20*b*. Positioned centrally of one face 20*a* (with respect to walls 20*d* and 20*e*), but positioned laterally of center of walls 20*b* and 20*c*, is an elongate, axially extending passageway 25 having an intermediate tapering portion 25*a* which leads into an inboard, lesser diameter portion 25*b* which opens into recess or bore 22. A like, but laterally displaced passageway 26 extends inwardly from the other face 20*a* having tapered portion 26*a* and inboard, lesser diameter portion 26*b* opening into bore 22 opposite from and laterally displaced from opening 25*b*.

As may be seen in FIG. 8, member 21 has like structure to member 20 with respect to bore 22, recess 23, arcuate protuberance 24 and passageways 25 and 26. Accordingly, this structure is numbered the same, but primed, with respect to elongate, wire receiving member 20 and will not be again redescribed.

There is additionally provided a central connector member, generally designated 27, which cooperates and fits into the bores 22 and 22' of members 20 and 21 in use and operation of members 20 and 21 in engagement and electrical connection of from two to four electricity conducting wires. Connector member 27 comprises a circular disc 28 having a pair of perforated paltes or blades 29 and 30 fixed one on each side of disc 27 and extending substantially normal thereto. Plates 29 and 30 are basically rectangular in form and of a length or outward extension from the disc 28 substantially equal to the depth of the recesses 22 and 22' in wire receiving members 20 and 21. Perforated plates 29 and 30 are oriented at right angles to one another and extend diametrically across the opposite faces of disc 28. Disc 28 is of a diameter substantially equal to the internal diameter of the bores or recesses 22 and 22' in wire receiving members 20 and 21. Where the inboard portions 22*a* and 22*a'* are conically formed, the outboard ends 29*a* and 30*a* of the perforated plates 29 and 30 of connecting member 27 are optionally bevelled from centrally outwardly in congruent fashion. In this manner, the bevelled ends of the said perforated plates 29 and 30 will pivot within the conical base portions 22*a* and 22*a*′ of bores 22 and 22′ when the wire receiving members 20 and 21 are engaging connecting member 27 in use, to be described.

While implicit in what has been said above, the width of plates 29 and 30 is equal to the inside diameter of bores 22 and 22′. Apertures 29*b* and 30*b* are provided in plates 29 and 30, specifically shown in FIGS. 2 and 7–10, inclusive as elongate slots adapted to receive therewithin the ends of at least two wires 31 and 32, which electricity-conducting wires have provided on the length thereof, except where same is stripped from wires 31 and 32, electrical insulation 31*a* and 32*a*. Individual holes for each wire may be provided.

Member 27 may omit disc 28 and still function. Disc 28 strengthens the member 27 and plates 29 and 30 in their connection to one another, and per se. It also aids in sealing the faces of members 20 and 21 to one another in use as well as holes 22 and 22′, with or without the presence of an O-ring or gasket as in FIG. 11.

ELECTRICAL CONNECTION OF WIRES (FIGS. 1–10)

The device of FIGS. 1–10, inclusive will now be described in the steps and process of the elements 20, 21 and 27 electrically interconnecting four wires 31, 32, 33 and 34. However, it should be understood that the device may be employed to electrically connect only two wires (provided one of each of said two wires is received in each one of the openings 29*b* and 30*b* of element 27) or, alternatively, three wires. In the latter case, one wire would be engaged by one of the slots or openings 29*b* or 30*b*, the other two wires being engaged by the other of the two slots or openings in the plates 29 and 30 of the member 27. In order to make a fully adequate and complete electrical connection between from two to four wires, all that is necessary is that the two to four wires be present at one location, with free ends thereof to be electrically connected together and, in addition, elements 20, 21 and 27 of a structure as previously described.

In order to make the electrical connection, then, between wires 31–34, inclusive, the adjacent free ends thereof are cleared of insulation in a length at least equal to the diameter of bores 22 and 22′ and the length of passages 25*b* and 26*b*, each wire. This necessary insulation-free length is seen in the left center portion of FIG. 3, for wire 31.

Figure 2:
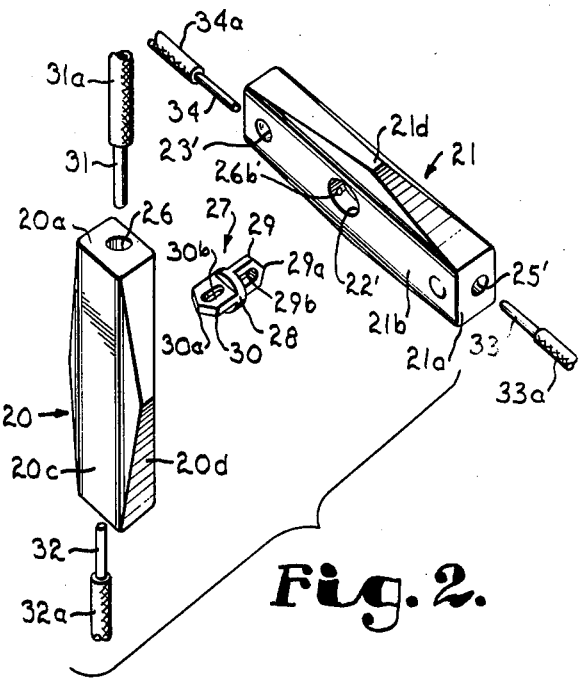

Starting, then, with the assembly, or pre-assembly conditions of FIG. 2, wires 31 and 32 are inserted in elongate, wire receiving member 20, with wire 31 being inserted in opening 26 and wire 32 into the opposite, laterally displaced opening 25 so that the wire ends 31 and 32 protrude into and across the bore 22, passing into the slot or opening 30*b* in plate 30, member 27 being partially inserted into bore 22 of member 20. This results in the initial engagement seen in FIG. 4 and the top portion of FIG. 7 with respect to member 20 and wires 31 and 32. Member 21 is then mounted over plate 29 of member 27 at right angles to member 20, as seen in FIGS. 6 and 7, and wires 33 and 34 inserted into opening 25′ and 26′, respectively, so that wires 33 and 34 protrude into and across the bore 22′ in member 21.

At this point, with the wires 31–34, inclusive fully inserted into members 20 and 21 and penetrating the plates 29 and 30 through slots 29*b* and 30*b*, the entire electrical connection (not yet made) is ready to be completed and activated. To do this, the electrician need only rotate the members 20 and 21 from taping right-angle position of FIGS. 6 and 7 to the parallel position of FIGS. 1 and 8, whereby plates 29 and 30, respectively, engage (for plate 29) wires 33 and 34 and, for plate 30, wires 31 and 32. When this right-angle transition is made, the protuberances 24 and 24′ engage the recesses 23 and 23′ to aid in maintaining the desired parallel position of FIGS. 1 and 8. At this stage, the wires immediately adjacent the members 20 and 21 may be removably tapered together. Additionally, if desired, but not necessarily, as in the case of the tapering of the wire portions adjacent members 20 and 21, the said members 20 and 21 may be removably taped in the parallel position illustrated in FIGS. 1 and 8. It should be noted that the presence of the four wires in the two plates (the slots thereof) prevent lateral detachment of the members 20 and 21 from one another (see FIGS. 8–10). This rigid locking of the device by the crimped wires therein obviates the necessity of additional securement except in the most extraordinary circumstances.

FIGS. 9 and 10 clearly demonstrate the final position and configuration of the wires 31–34, inclusive in the engagements thereof with the plates 29 and 30 in the bores 22 and 22′. Thus it may be seen that this electrical (and physical) connection additionally effectively prevents and obviates the axial removal of the wires 31–34, inclusive from members 20 and 21, so long as same are in the parallel, activated positions of FIGS. 1 and 8. Accordingly, it will be seen that the members 20, 21 and 27, when so positioned with respect to one another and the four wires 31–34, inclusive, and when activated from the right angle position of FIGS. 6 and 7 into the parallel position of FIGS. 1 and 8, provide a complete, powerful, reliable and secure physical engagement of the wires by the said members and, additionally, provide an absolutely reliable, continuously effective electrical connection between the wires 31–34, inclusive.

Figure 7:
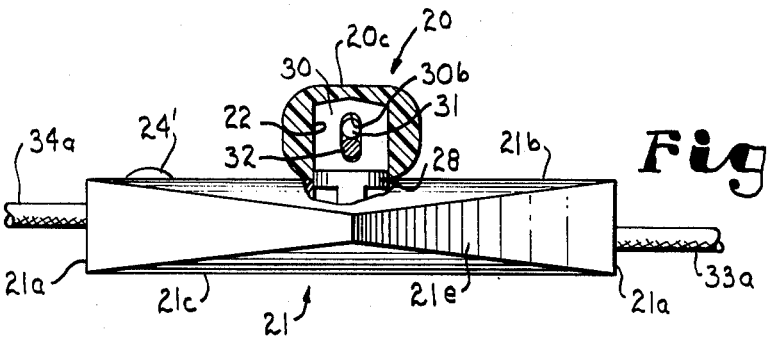

In order to disengage the electrical connection (and physical connection) of wires 31–34, inclusive, the members 20 and 21 need merely be rotated 90° with respect to one another in reverse rotation to the original arcuate displacement from the parallel position of FIGS. 1 and 8 to the right angle positions of FIGS. 6 and 7, whereby the wires 21–34, inclusive may be removed from their engagement in members 20 and 21 and with the plates 29 and 30 of member 27. In the event that members 20 and 21 were taped together in the parallel position of FIGS. 1 and 8 and/or wires 31–34, inclusive exterior of members 20 and 21 were taped together, such tape engagement must, of course, be removed before the disengagement of the connectors in the manner described.

After disengagement of the connection and removal of the wires from engagement with members 20, 21 and 27, the said members 20, 21 and 27 may be separated from one another in the manner seen in FIG. 2 for storage or for use in another electrical connection using the same or different wires herewith.

STRUCTURE OF FIG. 11

FIG. 11 shows a connector structure which is identical to the connector structure of FIGS. 1–10, inclusive, save for three features:

1. With respect to the center connector member of electricity conducting material comprising two plates at right angles to one another, optionally with a center cylindrical disc interconnecting same, the said cylindrical disc is thickened so that it may be employed in connection with a sealing O-ring received in grooves formed at the outlets to the bores in each of the wire receiving members; and 2. The sides of the bores in the wire receiving members opposite from those sides into which the wire carrying passages penetrate are drilled or formed so as to have openings or holes therein to receive the free ends of the wires.

3. Individual holes are provided in the blades for the wires.

Since the structure of the connector seen in FIG. 11 is identical save for these three above differences, all of the parts of the connector of FIG. 11 which are the same or substantially the same as the parts of the connector of FIGS. 1–10, inclusive are numbered the same. It should be commented that the upper portion of FIG. 11 shows substantially the same construction as the upper portion of FIG. 7. Likewise, the lower portion of FIG. 11 shows substantially the same structure as seen in the upper half of FIG. 8, but turned 180° and before the two wire receiving members are turned axially in line with one another.

The new passages or openings which are opposite the openings 25*b*′ and 26*b*′ in the walls of bore 22′ are numbered 40. It may be seen that cylindrical disc 28 of the center connecting member having plates 29 and 30 thereon is considerably thicker, thus spanning grooves 41 (and member 20) and 42 (in member 21) which contains O-ring 43.

The described changes of the device of FIG. 11 make possible provision for special weather tight service.

FIGS. 12–14, INCLUSIVE STRUCTURE

The device of FIGS. 12–14, inclusive is considerably analogous to the use of one-half of each of the wire receiving members in the connector of FIGS. 1–10, inclusive. In its smaller form (illustrated) where only one incoming wire is employed to engage each wire receiving member, the connector of these figures is employed to electrically and physically connect together two wires. Where each one (or only one) of the wire receiving members is configured in the manner of the wire receiving member of FIG. 16 (to be described) where two wires are received therewithin, in parallel, the connector of FIGS. 12–14, inclusive can be employed to connect together two to four wires.

In the form specifically illustrated in these figures, there is provided a first wire receiving member generally designated 50 having a flat engaging face 50*a* on one side thereof and a cylindrical bore 51 in that side face thereof stopping short of the other opposite side face of a structure like bores 22 and 22′ of FIGS. 1–11, inclusive. Wire receiving member 50 has unbroken end or unpenetrated end 50*b*, while the opposite end 50*c* thereof (FIG. 14) has a wire receiving passage 52 entering thereinto which may be seen exiting into bore 51 at 52*a* in FIG. 12. The internal structure of passage 52–52*a* is preferably the same as the wire receiving passages previously described with respect to FIGS. 1–10, inclusive. A wire 53 having insulation 53*a* thereon is shown ready to engage wire receiving member 50 in FIG. 12 and engaged therewith in FIGS. 13 and 14 at its insulation free end.

The opposite like wire receiving member 54 is congruent or identical in configuration to member 50, having a like cylindrical bore (not seen), as well as a wire receiving passage 55 in the end 54*a* thereof which operates to receive wire 56 insulated as at 56*a* at its insulation free end.

The center electricity conducting member has perforated right angled plates 57 and 58 having holes 57*a* and 58*a* therein adapted to receive the wire ends 53 and 56, respectively, the plates 57 and 58 here shown as connected together at their bases by cylindrical disc 59.

The operation of the device of these figures comprises the insertion (for example) of plate 57 into bore 51 in the orientation seen in FIG. 12, thereafter followed by the insertion of the wire end 53 into passage 52 until it enters the bore 51 through passage 52*a* and engages the opening 57*a* and plate 57. Thereafter, member 54 is engaged over the plate 58 in the orientation seen in the exploded view of FIG. 12 so that the wire end 56 may be inserted down through passage 55 into opening 58*a* in plate 58.

FIG. 13 shows the two members 50 and 54 rotated 90° with respect to the initial starting position of FIG. 12, the members ending up with the wires 53 and 56 running in opposite directions. In FIG. 14, the members have been rotated 90° in the opposite direction so that the two wires end up running in the same direction. The ultimate position of the inserted wires in the members 50 and 54, in either the positions of FIGS. 13 or 14 is that as seen in FIGS. 8–10, inclusive, namely, with the wires locked in engagement against both lateral and longitudinal motion of the wire receiving members with respect to one another. Additionally, in either of the positions of FIGS. 13 and 14, the two members may be further wrapped or taped to insure against inadvertent rotation to a position where the wires can be removed. As previously noted with respect to the form of FIGS. 1–10, inclusive, the latter is required only under the most unusual circumstances.

The total 90° rotation of the two members from the starting position of FIG. 12 to the positions of either FIG. 13 or 14 is actually a 45° rotation of each of the members 50 and 54 in each case.

In order to disengage the connection, the same action is taken as in the form of FIGS. 1–10, inclusive, specifically, a rotation of the members 90° with respect to one another to the starting position as in FIG. 12, pulling out of the wires and lateral separation of the wire receiving members 50 and 54 will totally disassemble the connection and connector.

FIG. 15 CONSTRUCTION

Referring to FIG. 15, therein is shown a base structure generally designated 60 having an outboard flat face 60*a*. Base structure 60 may be the wall of a junction box, a circuit board or any other convenient structural member, so long as it is of electrically insulating character and material. Fixedly received within base structure 60 and most conveniently facing on the inboard, preferably flat face 60*b* thereof is a square or circular plate 61 having an inboard face 61*a*. Fixed to the said exposed inboard face of plate 61 may be a simple soldered wire connection, bus bar 70, or any other useful, conventional or other connection means for receiving and making an electrical connection with one or more electricity conducting wires.

Fixed to the outboard face 61*b* of plate 61 is an elongate, erect preferably substantially rectangular flat plate 62 having at least one hole or slot 63 therein between the outboard face 60*a* and the outboard end 62*a* of plate 62.

Shown in actual functioning connector relationship with plate or bar 62 is a wire receiving member generally designated 64 which is of the same structure as either one of the wire receiving members 50 or 54 (they are the same, as seen in those views) in FIGS. 12–14, inclusive. That is, member 64 has a bore 65 extending at right angles to the longitudinal axis of member 64 and also to the flat face 64*a* thereof which is also parallel to said longitudinal axis. Member 64 (as is the case of all of the wire receiving members 20, 21, 50, 54, etc. is of insulating material. There is additionally provided a wire receiving passage 66 which enters into the end 64*b* of member 64 and, in a preferably reduced diameter portion thereof 66*a*, intersects bore 65. An electricity conducting wire 67 insulated as at 67*a* is shown extending into passage 66 and 66*a* with the wire 67 entering into passage or hole 63 in plate 62.

As the section through member 64 is parallel to (and showing) the passage 66, as well as the longitudinal axis of member 64, it may be seen that the connector assembly of FIG. 15 is activated as in the manner of FIGS. 8–10, inclusive, of FIGS. 1–10, inclusive form, so that the wire is locked into its engagement with plate 62 and passage 66–66*a*. Yet further, because of the fixing of plate 62, as well as the face member 61 in base structure 60, member 64 may not be moved vertically (in the view of FIG. 15) off surface 60*a*. Said otherwise, from the initial engagement of wire 67 in passage 63 in plate 62, member 64 has been rotated 45° to crimp the end of wire 67 into locking engagement with plate 62, as well as member 64.

A recess 68 is formed in the flat face 64*a* of member 64 whereby to removably engage protrusions 69 which are positioned 180° opposed from one another on each side of plate 62. Thus a member 64 may be employed to engage plate 62 from either side thereof.

In order to disengage wire 67 from plate 62, the member 64 is moved toward the viewer 45° whereby passage 66*a* lines up axially with passage 63, thus permitting the removal of the wire 67 from its engagement with plate 62 and member 64 from its position over plate 62.

FIG. 16

The construction of FIG. 16 is precisely the same as that seen in FIG. 15 save for the facts that:

1. Two separate wire receiving passages are provided in the wire receiving member;
2. Two separate passages are provided in the connecting member of electricity conducting material;
3. The recesses and protrusions are not employed in the structure of FIG. 16 to aid in locking the position of the wire receiving member with respect to the base structure and the wire receiving plate;
4. The outboard end of the wire receiving plate and the bore receiving same are not beveled or tapered.

In view of the fact that the structures are the same, save for the differences noted, all of the parts in the view of FIG. 16 which are the same or substantially the same as that of FIG. 15 are numbered the same, but primed. Like parts will not again be described. The view of FIG. 16 is also like that of FIG. 15 in that the two wires engaged with the plate 62 and the member 64' are also locked therein by rotation of the member 64' 45° (or more) from the axial alignment position of the passages 66*a'* with the holes 63' in the plate.

FIG. 19 CONSTRUCTION

The construction of FIG. 19 is a useful variation of the connector of FIGS. 1–10, inclusive. It differs from the construction of FIGS. 1–10, inclusive only in that the center member (28–30, inclusive in FIGS. 1–10) is made in two parts, with these two parts being separated, one from the other, by a plate of insulating material. Functionally, this means that two wires may be connected, one to the other on each side of the said insulating plate (to be described), but all of the wires joined together are not electrically connected, one to the other.

In the upper part of FIG. 19 there is shown member 100 which is precisely identical to either one of members 20 or 21 of the device of FIGS. 1–10, inclusive. Accordingly, the detailed construction of member 100 will not be described. In the lower part of FIG. 19, there is seen member 101 which, again, is an exact duplicate of either one of members 20 or 21 of FIGS. 1–10, inclusive. Specifically, that is, there is a central bore 102 which is penetrated by the inboard end of two wire receiving passages, one of which, 103, is seen in the view of FIG. 19. The inboard end of the other, opposed passageway is seen in the view at 104. The flat engaging side 101*a* thereof is also visible, as is arcuate protuberance 105 and arcuate recess 106. As mentioned, members 100 and 101 are the same, one like the other, and they are also like either one of members 20 and 21 of the device of FIGS. 1–10, inclusive.

The centerpiece comprises a plate 107 having two flat opposed sides, one of which, 107*a*, is visible in the view. Two perforations 108 are provided adjacent the ends thereof operative to receive the arcuate protuberances 105 and 105' of the members 100 and 101. The faces 107*a* and 107*b* are congruent, essentially, to the flat faces of members 100 and 101, such as 101*a*.

Rigidly fixed to the faces 107*a* and 107*b* by bonding or other means are two perforated plates 109 and 110 each having a slot therein and each optionally having a circular disc base 111 and 112. These plates 109 and 110 are fixed at 45° angles to the longitudinal axis of member 107 and at right angles, one to the other. The plates are of electricity conducting material.

In operation of this device two end-stripped wires (not seen in FIG. 19) are inserted into the passages in each of members 100 and 101 when they are aligned as seen in FIG. 19 but receiving blades or plates 109 and 110 therewithin (see FIG. 4 for one side) so the wires thread the orifices or slots in blades 109 and 110. Members 100 and 101 are then rotated 45° each to align with plate 107, member 100 clockwise in the view and 101 counterclockwise. Results are as seen in FIGS. 8–10, inclusive. To remove the wires the reverse action is taken.

The result is that the two wires engaged in member 100 are electrically connected to one another only. The same is true of the wires engaging member 101.

FIGS. 17 and 18

FIGS. 17 and 18 show the use of the subject improved electrical connection means associated with a duplex outlet receptacle. The receptacle is generally designated 120 and has side walls 121 and end walls 122. Three internal circuit bars 123, 124 and 125 of conventional type are mounted within solid receptacle 120, here fixed in a block or body 129 of suitable insulating material. At the ends of circuit bars 123 and 125 there are provided conventional arcuate contact elements 123*a* and 125*a*, respectively. At the ends of circuit bar 124 there is provided arcuate or circular ground contact elements 124*a*. In conventional manner, suitable slots and openings are provided (lefthand side of FIG. 17) for the elements of two three-prong male plugs to be engaged with the two sets of ground and contact elements previously described (upper and lower).

All of what has been heretofore described with respect to FIGS. 17 and 18 is essentially conventional. The improvement relating to the instant invention lies in the provision of blades or plates 126, 127 and 128 integrally or rigidly connected intermediate the ends of the circuit bars 123–125, respectively. These blades each have therethrough an orifice, passage or slot such as seen in FIG. 17 at 126*a* on the portion of the blade 126. Blades 126–128, inclusive are angled at 45° to both the side walls 121 and end walls 122. Elements (individual) such as those seen in FIGS. 12–16, inclusive (one end input) or FIGS. 1–10, inclusive (both end input) may thus be mounted over each one of the three blade ends 126–128, inclusive in order to provide suitable electrical, power and ground connections to the said blade and thus to the circuit bars and their contact and ground elements. The application, function and disassembly of these connections is precisely as has been described with respect to the previous figures and will not be herein redescribed.

FIGS. 20 and 21

The device of these figures is a variation of the constructions of FIGS. 15–18, inclusive. Specifically, that is, it is desired to bring in and electrically and physically connect one or a plurality of wires to a central electricity conducting post, bus bar or junction in such manner that the input (or outtake) wires are readily initially and securely brought in to secure physical and electrical connection (which connection may be maintained indefinitely) yet with the capacity, at any time, of disconnect, of one or more wires brought to the central junction.

Accordingly, what is shown in FIGS. 20 and 21 is a receiver of insulating material generally designated 130. This receiver has a recess 131 formed in the body thereof. A bus bar 132 is securely fixed or mounted in recess 131 extending between and connecting into side walls 130*a* and 130*b*. Bus bar 132 is spaced inwardly and downwardly from the other walls of this structure which will be here defined as top wall 130*c* and end wall 130*d*. Bus bar 132 also has a plurality of openings 132*a* extending therethrough at spaced intervals therealong.

A plurality of individual wire receiving members 133–138, inclusive are mounted, in a set, one adjacent the other on bus bar 132, whereby to be pivotable thereon between two positions such as seen in full lines in FIG. 20. Each member 133–138, inclusive has a circular opening therethrough to receive bus bar 132 as is seen at 134*a* with respect to member 134 in FIG. 20.

As may be seen in the view of FIG. 21, from one to six wires can be electrically connected into bus bar 132 by insertion of a stripped end wire (as at 136 in FIG. 20) into an element when the element is in the dotted line position of FIG. 20. Securement is made by rotating the element 45° in either direction from the dotted line position of FIG. 20. Locking or securement means such as arcuate depressions and protuberances may be employed with the structure of FIGS. 20 and 21, but are not required. This device functions in the same manner with respect to wire insertion, engagement, disengagement and removal as the devices of FIGS. 15–19, inclusive, wherefore such will not again be redescribed.

From the foregoing, it will be seen that this invention is one well adapted to attain all of the ends and objects hereinabove set forth together with other advantages which are obvious and which are inherent to the apparatus.

I claim:

1. Means for electrically connecting a plurality of electrically conducting wires comprising, in combination, a pair of elongate, wire receiving members of electrically insulating material, and a connector member of electrically conducting material, each said elongate, wire receiving member having at least one, substantially flat side extending substantially parallel to the longitudinal axis thereof, each said wire receiving member having a like cylindrical bore extending into the said flat side thereof at substantial right angles to the longitudinal axis thereof, said bore positioned intermediate of the ends and sides of said member and stopping short in its depth of the opposite side of the member, and an elongate passageway extending substantially axially of each said elongate wire receiving member from one end thereof into said bore, said connector member comprising a pair of perforated plates each fixed one to the other at one end thereof, said plates each rectangular in form, of a length substantially equal to the depth of the bores in the wire receiving members, and a width substantially equal to the internal diameter of said bores, said perforated plates oriented at right angles to one another and adapted to simultaneously fit into and slidingly engage the walls of the respective bores in said members with the flat sides of said members in facing contact with one another.

2. Means as in claim 1 including a second, opposed, elongate passageway extending substantially axially of each said wire receiving member from the other end thereof into said bore.

3. Means as in claim 2 wherein said opposed passageways in each said wire receiving member are laterally spaced from one another.

4. Means as in claim 2 wherein each said plate, has at least two perforations and these said perforations axially align, when the connector member is received in two flat face abutting wire receiving members with the passageways in each wire receiving member.

5. Means as in claim 1 wherein each said wire receiving member is identical in form to the other and each has mating engaging means positioned on at least one side of the bore therein on the said substantially flat face thereof.

6. Means as in claim 5 wherein said latter means comprises one of a recess and a projection on one side of said bore adapted to mate with a mating means of opposite character on the other wire receiving member flat face.

7. Means as in claim 1 wherein each of said elongate passageways has a greater diameter length thereof outboard of said bore and a lesser diameter length entering said bore and a tapering length connecting said greater and lesser diameter lengths thereof.

8. Means as in claim 1 wherein the innermost portions of the bores in said wire receiving members are conically formed and the outboard ends of said perforated plates of said connecting member are bevelled from centrally outwardly in congruent fashion, whereby the bevelled ends of the said perforated plates pivot within the conical base portions of the bore when the wire receiving members are engaging said connecting member in use.

9. Means as in claim 1 wherein the perforations in said plates comprise an elongate slot in each plate adapted to receive a plurality of wires therein.

10. Means as in claim 1 wherein said connector member includes a circular disc having said pair of perforated plates fixed one on each side thereof and extending substantially normal thereto and to one another.

11. An electrical connection for at least wire comprising, in combination, an elongate, wire receiving member of electrically insulating material, and a connector member of electrically conducting material, said wire receiving member having a cylindrical bore extending therethrough at substantial right angles to the longitudinal axis thereof, said bore positioned intermediate of the ends and sides of said member, and an elongate passageway extending substantially axially of said elongate wire receiving member from one end thereof into said bore, said connector member comprising an elongate rectangular plate having at least one passage therethrough and having a width substantially equal to the internal diameter of said bore, said connector member plate oriented at right angles to the passageway in said wire receiving member and simultaneously fitting into, passing through and slidingly engaging the wall of the bore in said member, and a shroud of insulating material having a pair of spaced apart ends receiving and enclosing therebetween the ends of the connector member and an arcuate, open sided body of electrically insulating material interconnecting the said shroud ends.

12. In combination, an elongate, substantially rectangular base structure of electrically insulating material having two flat, opposed face portions, a pair of connector members of electricity conducting material connected one to each of said flat parallel opposed base structure face portions and electrically isolated from one another, each said connector member comprising an elongate upright plate secured at one end to said base structure and extending at substantial right angles to one of the said flat face portions thereof, each said connector member having a hole extending therethru spaced away from said base structure and from the free end of the member, and a pair of elongate, wire receiving members of electricity insulating material, each said elongate, wire receiving member having at least one, substantially flat side extending substantially parallel to the longitudinal axis thereof, each said wire receiving member having a cylindrical bore extending into the flat side thereof at substantial right angles to the longitudinal axis thereof, each said bore positioned intermediate of the ends and sides of said member and stopping short in its depth of the opposite side of the member, an elongate passageway extending substantially axially of each elongate wire receiving member from one end thereof into said bore, each said connector member plate substantially rectangular in form in the portion thereof extending away from said base structure, and of a length substantially equal to the depth of the bore in the wire receiving member, and a width substantially equal to the internal diameter of said bore, each said connector plate adapted to fit into and slidingly engage the walls of a bore in one of said wire receiving members when the flat side of said member is in facing contact with one face portion of said base structure, each of said connector plates positioned at 45° from the longitudinal axis of said base structure and in 90° opposition to one another.

13. Means as in claim 12 including a second, opposed elongate passageway extending substantially axially of each said wire receiving member from the other end thereof into said bore, the said opposed passageways in each said wire receiving member being laterally spaced from one another.

* * * * *